United States Patent [19]

Sinclair

[11] 4,148,407

[45] Apr. 10, 1979

[54] COLLAPSIBLE CONTAINER WITH LOADING RAMP

[76] Inventor: Lorne R. Sinclair, 1549 W. 32nd Ave., Vancouver, British Columbia, Canada, V6J 3A5

[21] Appl. No.: 899,206

[22] Filed: Apr. 24, 1978

[51] Int. Cl.[2] ..... B65D 7/24

[52] U.S. Cl. ..... 220/7; 49/246; 217/15

[58] Field of Search ..... 217/15, 47, 43 A; 220/7, 1 S; 206/600; 49/248, 249, 246

[56] References Cited

U.S. PATENT DOCUMENTS

| | | | |
|---|---|---|---|
| 836,029 | 11/1906 | Gregory | 217/15 |
| 908,988 | 1/1909 | Forkner et al. | 217/15 |
| 1,809,523 | 6/1931 | McLean | 220/7 X |
| 2,291,888 | 8/1942 | Ericksen | 220/7 X |
| 2,517,178 | 8/1950 | Cheatham, Jr. | 217/15 |
| 3,051,280 | 8/1962 | Bergman et al. | 49/249 |
| 3,333,720 | 8/1967 | Sinclair | 217/15 |
| 3,481,503 | 12/1969 | Kloess et al. | 220/1 S |
| 3,747,794 | 7/1973 | Bitney | 217/15 |

*Primary Examiner*—William Price
*Assistant Examiner*—Allan N. Shoap
*Attorney, Agent, or Firm*—Townsend and Townsend

[57] ABSTRACT

A container comprises a rectangular top, bottom and sides. The sides each have two ends which are normally vertical. There is a hinge generally adjacent the bottom and one side permitting the one side to pivot outwardly. There is an angle section with an outwardly directed flange near each end of the one side and channel sections with inwardly directed flanges on the ends of the two other sides adjacent ends of the one side. The angle sections are engageable with the channel sections to constrain outward movement of the one side about the hinge. A latch constrains inward movement of the one side when the latch is engaged. A mechanism can deflect the outwardly directed flanges to permit the one side to pivot outwardly about the hinge for loading and unloading the container.

12 Claims, 4 Drawing Figures

COLLAPSIBLE CONTAINER WITH LOADING RAMP

BACKGROUND OF THE INVENTION

This invention relates to shipping containers with sides that pivot outwardly for loading and unloading the containers.

The provision of outwardly pivotable sides on shipping containers has been suggested in the past, for example in U.S. Pat. No. 1,080,553 to Herzfeldt. The use of such a side as a ramp for unloading and loading the container is disclosed in U.S. Pat. No. 3,747,794 to Bitney.

U.S. Pat. No. 2,517,178 to Cheatham describes a folding container, the sides of which have interlocking channels and angles. However, Cheatham does not disclose means for lowering the sides outwardly for use as a ramp.

The use of leaf springs for locking the sides of collapsible shipping containers in place is disclosed in U.S. Pat. No. 945,228 to Fowler.

Shipping containers are subject to considerable abuse and the contents of a container exert relatively large forces against the sides of the container. Consequently, it is not suprising that collapsible shipping containers have been developed which provide means preventing outward movement of the sides which extends along the vertical corners of the container. However, while U.S. Pat. No. 3,747,794 to Bitney and U.S. Pat. No. 1,080,553 to Herzfeldt disclose outwardly pivoted sides, they do not provide means for preventing outward movement of the sides which extends along the vertical ends of the sides from the top to the bottom of the container.

SUMMARY OF THE INVENTION

A container comprises: a generally rectangular top, bottom and four sides, the sides each having two ends which are normally vertical; hinge means generally adjacent the bottom and one side permitting the one side to pivot outwardly; first members with outwardly directed flange means near the ends of the one side; second members with inwardly directed flange means on the ends of two other sides adjacent the ends of the one side, the first members being engageable with the second members to constrain outward movement of the one side about the hinge means; latch means constraining inward movement of the one side when engaged; and disengaging means for deflecting the outwardly directed flange means to permit the one side to pivot outwardly about the hinge means for loading and unloading the container.

A container according to the invention has the advantage of one side which is pivotable outwardly to facilitate loading and unloading of the container, and, at the same time, maintains relatively rigid and secure means for constraining outward movement of the pivotable side as has been found desirable for collapsible containers. The flanges can extend from near the bottom to near the top of the container to interlock the outwardly pivotable side with the two adjacent sides along their vertical ends.

In drawings which illustrate embodiments of the invention:

DESCRIPTION OF THE PREFERRED EMBODIMENTS

Figure 1:
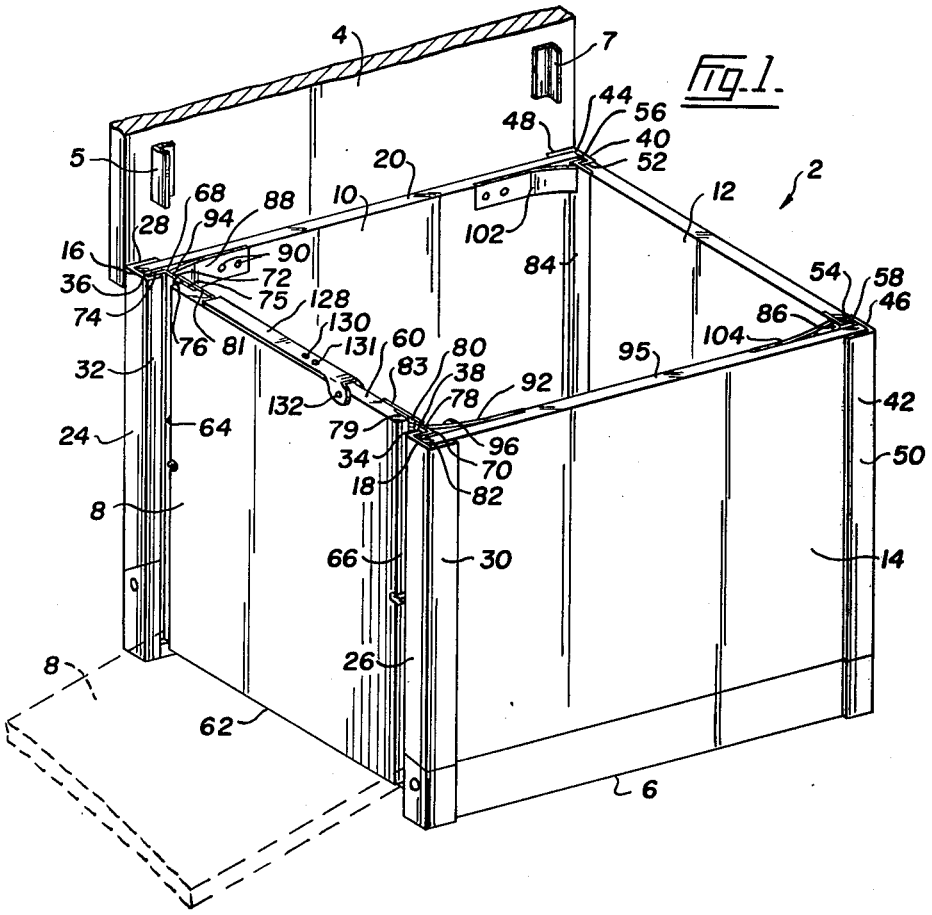
FIG. 1 is an isometric view of a collapsible container according to an embodiment of the invention.

Referring to the drawings, a collapsible container 2 is provided with a top 4, a bottom 6, and four vertical sides 8, 10, 12 and 14. As shown in FIG. 1, the top 4 is in the open position. All four sides 8, 10, 12 and 14 are hinged adjacent the bottom 6 for tilting inwardly towards the bottom 6. As shown in FIG. 1, the container 2 is set up with the four sides 8, 10, 12, and 14 in a fixed vertical position and the top 4 is opened.

Sides 10 and 14 have first vertical ends 16 and 18 respectively. Second members or channel sections 24 and 26 are fitted over the ends 16 and 18 and extend from under the top 4 to the bottom 6 of the container 2. The outer flanges 28 and 30 of channels 24 and 26 rest against sides 10 and 14. Inner flanges 32 and 34 of channels 24 and 26 are spaced apart from sides 10 and 14 by vertically extending slots 36 and 38. Similarly, sides 10 and 14 are also fitted with channels 40 and 42 on second vertical ends 44 and 46. Channels 40 and 42 are provided with outer flanges 48 and 50 and inner flanges 52 and 54. Flanges 52 and 54 are spaced apart from sides 10 and 14 by vertically extending slots 56 and 58 respectively.

Side 8 of container 2 has a top 60, a bottom 62, and vertical ends 64 and 66. Vertically oriented first members or angle sections 68 and 70 are connected to vertical ends 64 and 66 of side 8 and extend from the top 60 to the bottom 62. Angle section 68 has a flange 72 extending from side 8 towards side 10 and a flange 74 extending perpendicularly and outwardly from flange 72 adjacent side 10. In the position of the sides of container 2 shown in FIGS. 1 and 2, flange 74 of angle section 68 is received within slot 36 between flange 32 of channel 24 and side 10. Flange 32 of channel 24 abuts flange 72 of angle section 68 and prevents outward movement of side 8. Flange 72 is hingedly connected to vertically extending hinge member 75 by hinge 76 which extends vertically adjacent end 64 of wall 8 from the top 60 to the bottom 62 of side 8. Member 75 is connected to side 8 by suitable fasteners such as screws. Similarly, angle section 70 has a flange 78 and an outwardly extending flange 82 receivable within slot 38 between flange 34 of channel section 26 and side 14. Angle section 70 is connected to hinge member 79 by hinge 80. Similar angle sections 84 and 86 are fixedly connected along vertical ends of wall 12 with outwardly directed flanges receivable in slots 56 and 58 respectively. Flat steel strips 81 and 83 are fastened to the inside of side 8 adjacent ends 64 and 66 by nails 85 to reinforce wall 8 and to prevent hinges 76 and 80 from pivoting inwardly of the container 2.

A leaf spring 88 is connected to side 10 near its top 20 and side 8 and extends towards flange 72 of angle section 68, when side 8 is vertical, while curving away from side 10. Spring 88 is connected to side 10 by suitable fasteners such as nails 90. Similarly, leaf spring 92 is connected to side 14 near its top 95 and side 8 and extends towards flange 78 of angle section 79 while curving away from side 14. End 94 of leaf spring 88 and end 96 of leaf spring 92 contact angle sections 68 and 70 respectively to normally prevent side 8 from tilting inwardly about its bottom 62. Stops 5 and 7, comprising short angle sections, contact the interior side of sides 8 and 12 when top 4 is closed to also assure that sides 8 and 10 can't pivot inwardly.

Figure 3:
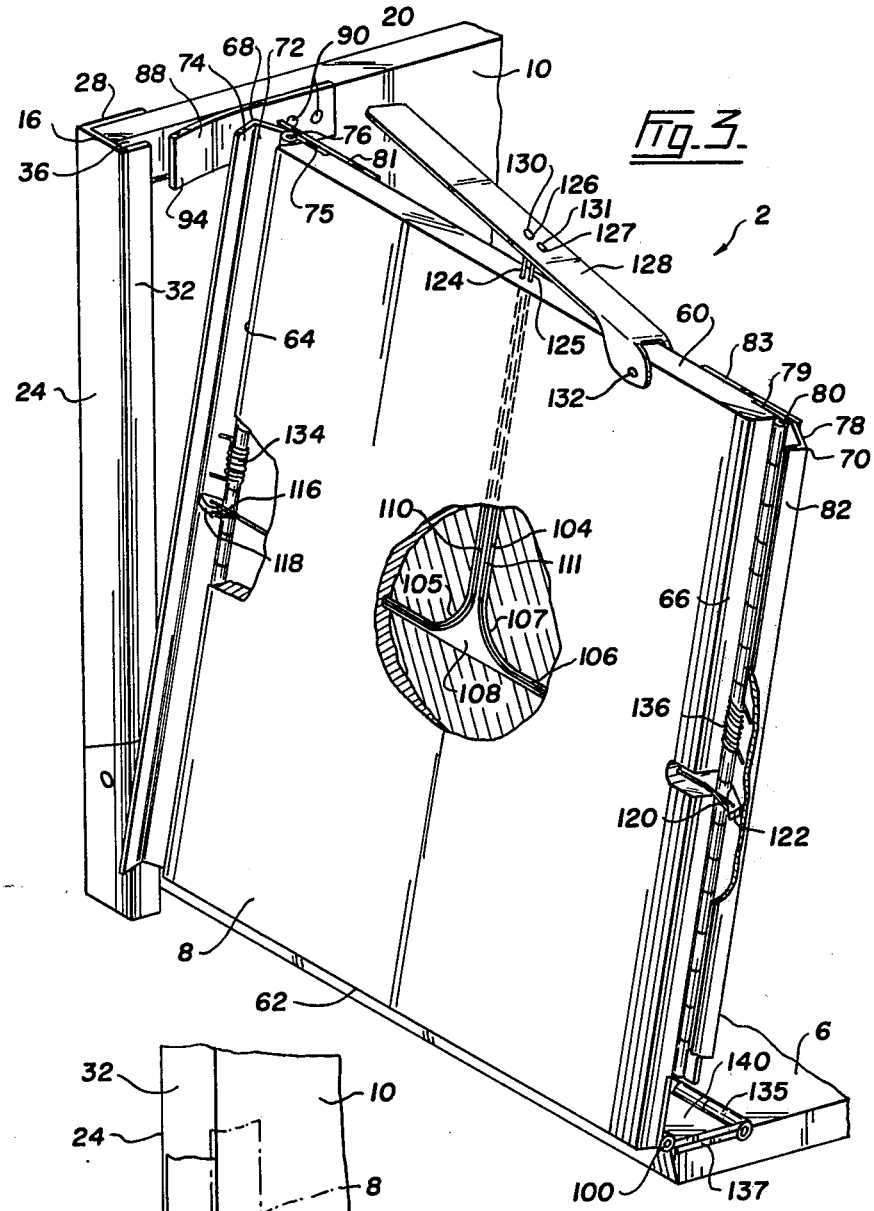
FIG. 3 is a fragmentary isometric view showing one side of the container of FIG. 1 tilted inwardly from its closed position with the one side partly broken-away.

When end 94 of leaf spring 88 is pressed towards side 10, it clears angle section 68 because of slot 36 between side 10 and angle section 68. Similarly, when end 96 of leaf spring 92 is pressed towards side 14, it clears angle section 70 because of slot 38 between side 14 and angle section 70. Thus, when leaf springs 88 and 92 are pressed against sides 10 and 14 respectively, side 8 can be tilted inwardly about hinge 100 as shown in FIG. 3. An identical mechanism involving leaf springs 102 and 104 allows side 12 to tilt inwardly from the vertical position shown in FIG. 1. In summary, in this kind of collapsible container, the sides are collapsible inwardly in a given sequence and the top of the container can be positioned directly over the bottom. In this collapsed condition, the container is substantially flat and less bulky and is easier to handle when empty. The collapsed expanded ratio of volumes is approximately 3.5 to 1.

Referring now to side 8, a bore 104 extends downwardly from the centre of top 60 to communicate with horizontal bore 106 extending from end 64 to end 66 of side 8. A hollowed out central portion 108 provides outwardly curving transitions 105 and 107 from vertical bore 104 to ends 64 and 66 of side 8 along horizontal bore 106. Steel cables 110 and 111 extend slidably downwardly through vertical bore 104 and then outwardly towards ends 64 and 66 through bore 106. Outside end 116 of cable 110 is connected to tab 118. Tab 118 is connected to flange 72 of angle section 68 by suitable means, such as by welding. End 120 of cable 111 is connected to a similar tab 122 connected to flange 78 of angle section 70. Top end 124 of cable 110 and top end 125 of cable 111 extend above top 60 of side 8 and pass through apertures 126 and 127 of lever 128. A knot 130 is formed on end 124 of cable 110 above lever 128 with a similar knot 131 on cable 111. Lever 128 is pivotably connected to side 8 near top 60 by pin 132. A coil spring 134 surrounds hinge 76 and resiliently connects angle section 68 and side 8 adjacent tab 118. Similarly, a coil spring 136 surrounds hinge 80 and resiliently connects angle section 70 and side 8 adjacent tab 122. Springs 134 and 136 normally bias angle sections 70 and 68 towards the positions shown in FIGS. 1 and 2.

Figure 4:
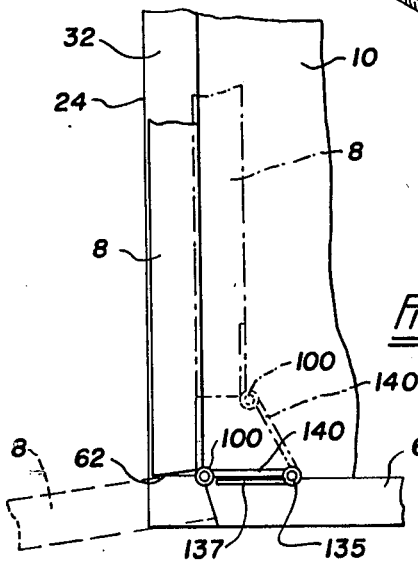
FIG. 4 is a fragmentary side elevational view showing various positions of the side of the container shown in FIG. 3 which is tiltable inwardly and outwardly from the vertical position.

Referring to FIGS. 3 and 4, first hinge 100 is connected to a second hinge 135 located inwardly on bottom 6. Hinges 100 and 135 comprise a single unit 137 connected to bottom 6 and side 8 by screws. A flat elongate metal strip 140 connects hinge 100 and hinge 135 along bottom 6 and adjacent side 8. Side 8 is consequently double hinged to bottom 6. Referring to FIG. 4, it may be seen that side 8 is pivotable outwardly about hinge 100. As well, strip 140 is pivotable upwardly about hine 135.

For many purposes, access to the interior of the container 2 is much easier through one of the sides 8, 10, 12 or 14, rather than through the open top 4. In container 2, side 8 is pivotable outwardly about hinge 100 to form a downwardly inclined ramp with top 60 of side 8 touching the surface upon which the container 2 rests. Side 8 is shown in this position in broken lines in FIGS. 1 and 4.

Figure 2:
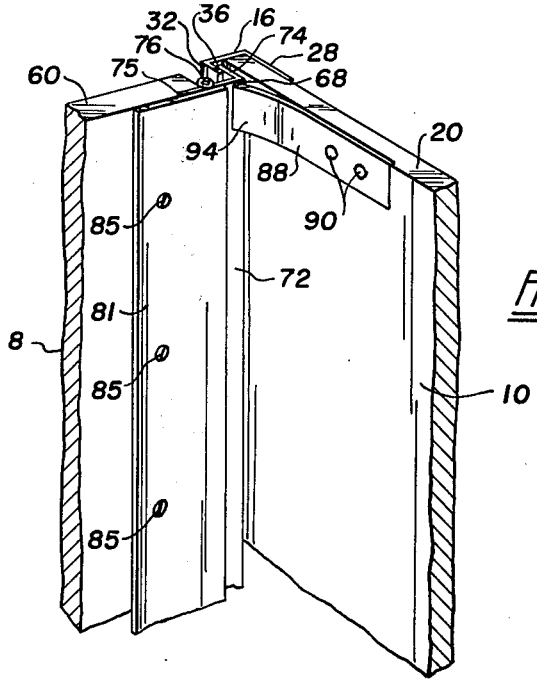
FIG. 2 is a fragmentary isometric view of the upper portion of one corner of the container shown in FIG. 1.

In the vertical position of side 8, as shown in solid lines in FIGS. 1, 2 and 4, leaf springs 88 and 92 comprise catches constraining inward movement of side 8 when engaged. When ends 94 and 96 of leaf springs 88 and 92, respectively, are depressed until they rest against sides 10 and 14 respectively and clear angle sections 68 and 70, side 8 is permitted to pivot inwardly about hinge 100. Side 8 is rotated inwardly towards bottom 6 until outwardly directed flanges 74 and 82, of angle sections 68 and 70 respectively, clear inwardly directed flanges 32 and 34 of channel sections 24 and 26 adjacent bottom 6 of container 2. Lever 128 is then raised to the position shown in FIG. 3. This pulls cables 110 and 111 upwardly and inwardly to rotate outwardly directed flanges 74 and 82 towards one another as shown in FIG. 3. Side 8 is then rotated outwardly about hinge 100 and outwardly directed flanges 74 and 82 clear inwardly directed flange 32 and 34, as shown in FIG. 3. In this way, lever 128 and cables 110 and 111 act as disengaging means for deflecting the outwardly directed flanges 74 and 82. Side 8 can then be rotated to the downwardly inclined ramp position shown in broken lines in FIGS. 1 and 4. In this position, side 8 acts as a ramp and, for example, a fork lift can enter the interior of container 2 over side 8. It is convenient for the unloading of small containers, as described below, to load the goods on a platform, for example of plywood, to be positioned on the bottom 6.

When container 2 has been loaded, it is necessary to restore side 8 to the position shown in FIG. 1. To do this, side 8 is first rotated upwardly about hinge 100 to the vertical position. However, angle sections 68 and 70 are then not engaged with channel sections 24 and 26. To accomplish this, strip 140 is rotated upwardly about hinge 135 by lifting side 8 vertically to the position shown in chain lines in FIG. 4. By employing the two spaced-apart hinges 100 and 135, side 8 and angle sections 68 and 70 can inwardly clear channel sections 24 and 26 while encrouching very little upon the interior space of container 2. This is highly desirable since the container would now be filled and it would no longer be possible to rotate side 8 inwardly about hinge 100 to clear channel sections 24 and 26. After side 8 has been raised and held in the vertical position shown in chain lines in FIG. 4, springs 134 and 136 rotate flanges 74 and 82 apart to the position shown in FIGS. 1 and 2. Side 8 is then pushed outwardly until leaf springs 88 and 92 engage with angle sections 68 and 70, respectively, and side 8 is pushed downwardly, rotating strip 140 about hinge 135 until bottom 62 of side 8 is adjacent bottom 6 of container 2. The loaded container is thus restored to the condition shown in FIG. 1. When top 4 is secured, the container 2 is ready for shipment.

Of course, the unloading of container 2 is accomplished in a similar manner. Springs 88 and 92 are depressed until they disengage from angle sections 68 and 70. Side 8 is then raised and moved inwardly to the position shown in chain lines in FIG. 4. Lever 128 is raised to move flanges 74 and 82 towards each other and side 8 is rotated outwardly about hinge 100 to the position shown in broken lines in FIGS. 1 and 4. If the goods have been loaded on the platform mentioned above, it is merely necessary to attach a cable or the like to the platform and pull the platform out of container 2 and down side 8 actings as a ramp. Strips 81 and 83 act as skids for unloading. After unloading, side 8 can be raised about hinge 100 and rotated inwardly to clear channels 24 and 26. Normally, container 2 is then collapsed to the flattened condition for shipment back to the loading point.

The preferred material for top 4, bottom 6, and sides 8, 10, 12 and 14 is plywood. Alternatively the container could be fabricated with metal or other materials. The angle sections, channel sections, lever, leaf springs, cables and similar components are preferably made of steel.

Though this container 2 is the collapsible type, the invention may also be useful in providing an outwardly pivotable side for a non-collapsible container.

What I claim is:

1. A container comprising:

a generally rectangular top, bottom and four sides, the sides each having two ends which are normally vertical;

hinge means generally adjacent the bottom and one side permitting the one side to pivot outwardly;

first members with outwardly directed flange means near the ends of the one side;

second members with inwardly directed flange means on ends of two other sides adjacent the ends of the one side, the first members being engageable with the second members to constrain outward movement of the one side about the hinge means;

means constraining inward movement of the one side when engaged;

and disengaging means for deflecting the outwardly directed flange means to permit the one side to pivot outwardly about the hinge means for loading and unloading the container.

2. A container as claimed in claim 1 wherein the first and second members extend from near the top to near the bottom of the container.

3. A container as claimed in claim 2, wherein the disengaging means comprises means for rotating the outwardly directed flange means towards each other generally about the ends of the one side.

4. A container as claimed in claim 3, wherein the hinge means permits the one side to pivot inwardly so that the disengaging means can rotate the outwardly directed flange means towards each other and the one side can thereafter be pivoted outwardly about the hinge means to a generally horizontal position.

5. A container as claimed in claim 4, wherein the hinge means comprises two spaced-apart hinges, a first hinge being located generally adjacent an outside edge of the bottom of the container and a second hinge being located inwardly from the first hinge and being connected to the first hinge, the two hinges permitting the one side to be raised from the generally horizontal position to a generally vertical position wherein the outwardly directed flange means are inwardly disengaged from the inwardly directed flange means so that the outwardly directed flange means can be rotated towards one another and the outwardly directed flange means will thereafter disengage with the inwardly directed flange means when the one side is moved outwardly.

6. A container as claimed in claim 5, the first members comprising two angle sections, each angle section being connected to the one side by hinges generally along the ends of the one side from near the top of the container to near the bottom of the container, the outwardly directed flange means comprising a flange of each angle section.

7. A container as claimed in claim 6, wherein the disengaging means comprises a lever pivotally mounted on the one side and linkages connecting the lever to the angle sections.

8. A container as claimed in claim 7, wherein the angle sections are resiliently biased about the hinges to return the flanges to the outwardly directed position by rotating the flanges away from each other after the flanges have been rotated towards each other by the disengaging means.

9. A container as claimed in claim 8, the lever being pivotally mounted near the top of the one side of the container and the linkages comprising cables connecting the lever with each angle section, the cables passing through conduits in the one side.

10. A container as claimed in claim 9, the means constraining inward movement comprising leaf springs located near the top of the sides of the container adjacent the one side, the leaf springs permitting inward rotation of the one side about the hinges when depressed.

11. A container as claimed in claim 10, the second members comprising channel sections fitted over the ends of the sides of the container adjacent the one side, the inwardly directed flange means comprising an inwardly directed flange of each channel section, the inwardly directed flanges being spaced apart from sides of the container adjacent the one side, the outwardly directed flanges being positionable between the sides of the container adjacent the one side and the inwardly directed flanges of the channel sections to engage the angle sections with said channel sections.

12. A container as claimed in claim 11, the one side being adapted to operate as a ramp for loading or unloading the container when rotated outwardly about the hinges.

* * * * *